US007171764B2

(12) United States Patent
Pfander

(10) Patent No.: US 7,171,764 B2
(45) **Date of Patent: *Feb. 6, 2007**

(54) INSOLE CONSTRUCTION FOR FOOTWEAR

(75) Inventor: Wilhelm Pfander, Brewer, ME (US)

(73) Assignee: Phoenix Footwear Group, Inc.CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/095,536

(22) Filed: Apr. 1, 2005

(65) Prior Publication Data

US 2005/0166424 A1 Aug. 4, 2005

Related U.S. Application Data

(63) Continuation of application No. 10/718,651, filed on Nov. 24, 2003, now Pat. No. 6,922,914, which is a continuation of application No. 09/360,155, filed on Jul. 26, 1999, now Pat. No. 6,675,501.

(51) Int. Cl.
*A43B 13/18* (2006.01)
*A43B 13/38* (2006.01)
*A43B 13/20* (2006.01)
*A61F 5/14* (2006.01)

(52) U.S. Cl. ..... 36/28; 36/44; 36/3 B; 36/141; 36/30 R

(58) Field of Classification Search ..... 36/11.5, 36/44, 43, 28, 30 R, 29, 31, 3 R, 3 B, 25 R, 36/7.5, 7.8, 141
See application file for complete search history.

(56) References Cited

U.S. PATENT DOCUMENTS 578,794 A 3/1897 Warner
895,950 A 8/1908 Von Bracht
1,540,430 A 6/1925 Sims
1,981,300 A 11/1934 Berg
2,164,877 A 7/1939 Le Clair
2,237,190 A 4/1941 McLeod
3,252,231 A 5/1966 Gilkerson
3,418,731 A 12/1968 Anciaux
4,223,455 A 9/1980 Vermeulen
4,674,203 A 6/1987 Goller
4,733,483 A 3/1988 Lin
4,831,749 A 5/1989 Tsai
5,035,068 A 7/1991 Biasi
5,222,311 A 6/1993 Lin
5,233,767 A 8/1993 Kramer
5,255,451 A 10/1993 Tong et al.
5,400,526 A 3/1995 Sessa
5,542,196 A 8/1996 Kantro
5,619,809 A 4/1997 Sessa
5,755,001 A 5/1998 Potter et al.
5,799,413 A 9/1998 Argyris
5,845,418 A 12/1998 Chi
5,983,524 A 11/1999 Polegato
5,993,585 A 11/1999 Goodwin et al.

*Primary Examiner*—Anthony Stashick
(74) *Attorney, Agent, or Firm*—Nixon & Vanderhye, PC

(57) ABSTRACT

An insole construction for footwear comprising a base member, an intermediate member formed of a foam and having a plurality of substantially uniformly spaced raised cushioning elements on the upper surface thereof, and a flexible cover member surrounding the intermediate member and extending beneath the base member. The intermediate member preferably is formed of a foam such as polyurethane foam. The raised cushioning elements are of a height of approximately 6 millimeters above the upper surface of the intermediate member and are spaced approximately 10–30 millimeters from each other.

17 Claims, 4 Drawing Sheets

INSOLE CONSTRUCTION FOR FOOTWEAR

CROSS REFERENCE TO RELATED APPLICATION

This application is a continuation of application Ser. No. 10/718,651 filed on Nov. 24, 2003, now Pat. No. 6,922,914 which is a continuation of application Ser. No. 09/360,155 filed on Jul. 26, 1999, now U.S. Pat. No. 6,675,501.

BACKGROUND OF THE INVENTION

The present invention relates generally to an insole construction for footwear and, more particularly, to such an insole construction which provides increased comfort and support for the foot of the wearer.

Recent efforts to provide footwear which is both comfortable and anatomically beneficial to the wearer have resulted in many concepts having varying degrees of effectiveness. Most of these concepts are merely variations of other concepts which have been around for years. Historically, there have been a number of attempts to increase the cushioning and support of footwear by making modifications to the insole or midsole. These attempts have been subject to one or more of the following disadvantages:

1. They have been complicated in construction;
2. They have been difficult to manufacture;
3. They have been expensive to manufacture;
4. They have not been durable;
5. They have not been sufficiently comfortable; and,
6. They have not provided adequate support and stability for the foot of the wearer.

The insole construction of the present invention is not subject to any of the above listed disadvantages and provides advantages which have not been achieved in prior footwear constructions.

SUMMARY OF THE INVENTION

The insole construction of the present invention comprises a relatively flat, flexible base member, an intermediate member formed of a relatively soft foam such as polyurethane foam and having a plurality of upstanding, spaced raised portions or cushioning elements on the upper surface thereof, and a flexible cover member which surrounds the intermediate member and extends below and is secured to the base member to provide a unitary construction.

The base member may be provided with a plurality of perforations to increase the flexibility thereof. The cover member may be formed of leather and also provided with a plurality of perforations for the purpose of increasing the breathability thereof.

The intermediate member preferably is formed of a polyurethane foam having a density rating so that it is relatively soft in the nature of foam used for a mattress, upholstered chair or the like. In a preferred embodiment, the intermediate member has a thickness of approximately 6 millimeters and the raised cushioning elements thereof are approximately 6 millimeters in height. The raised cushioning elements preferably are spaced approximately 10–30 millimeters from each other. Because of the flexibility, spacing and size of the raised cushioning elements, they provide enhanced comfort and support to the foot of the wearer and also are self-adjusting to the wearer's foot so that it does not slide on the insole and thus is very stable when positioned thereon during walking or the like.

In the use of the insole construction of the present invention, it is preferably mounted on and secured to an outsole of any suitable anatomical shape and construction. The insole construction of the present invention is especially advantageous in sandal-type footwear because of the support and stability it provides for the wearer's foot, and is also useful in other types of footwear having a conventional upper or the like.

DESCRIPTION OF THE PREFERRED EMBODIMENTS

Figure 1:
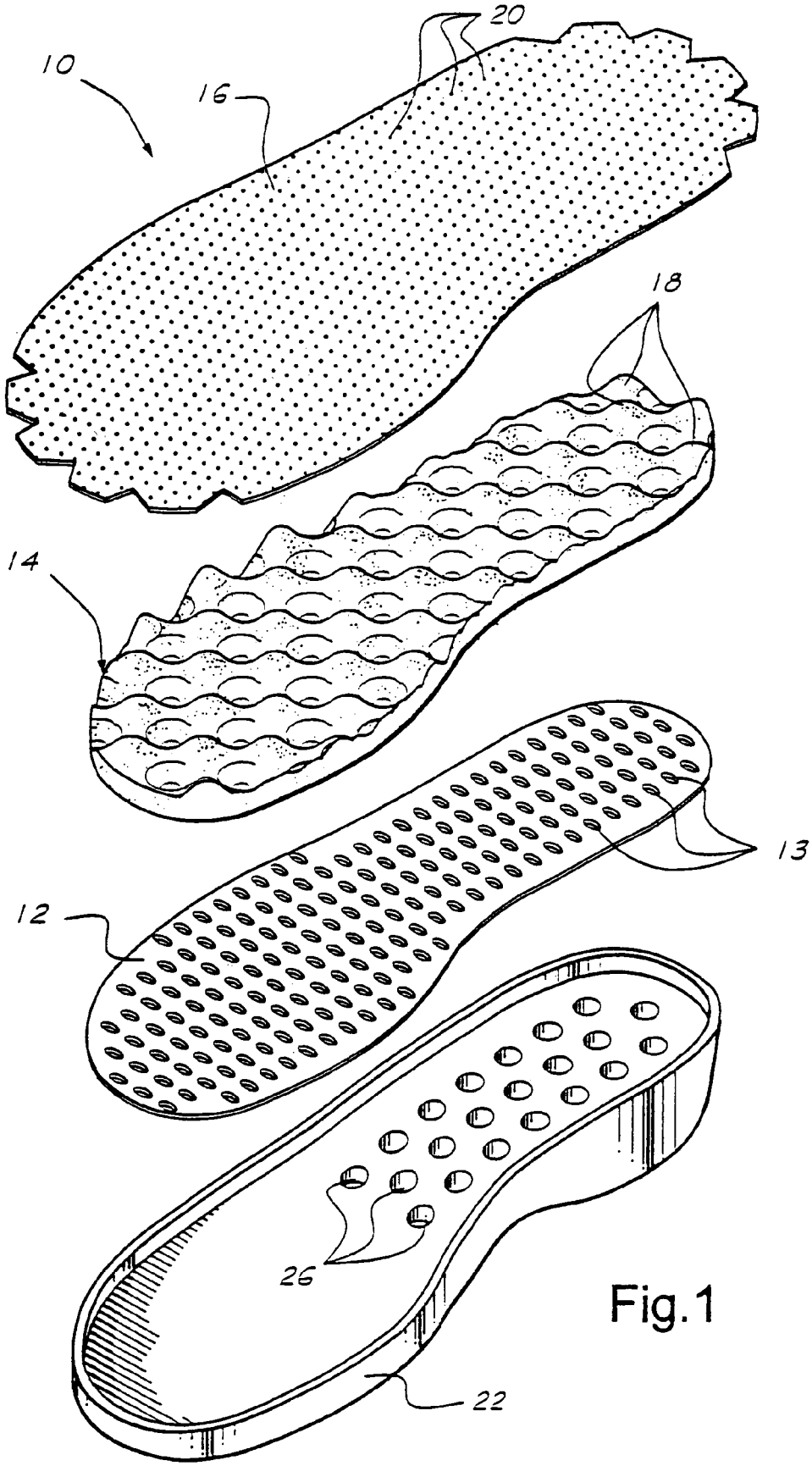
FIG. 1 is an exploded perspective view of the insole construction of the present invention and an outsole useable therewith.
Figure 2:
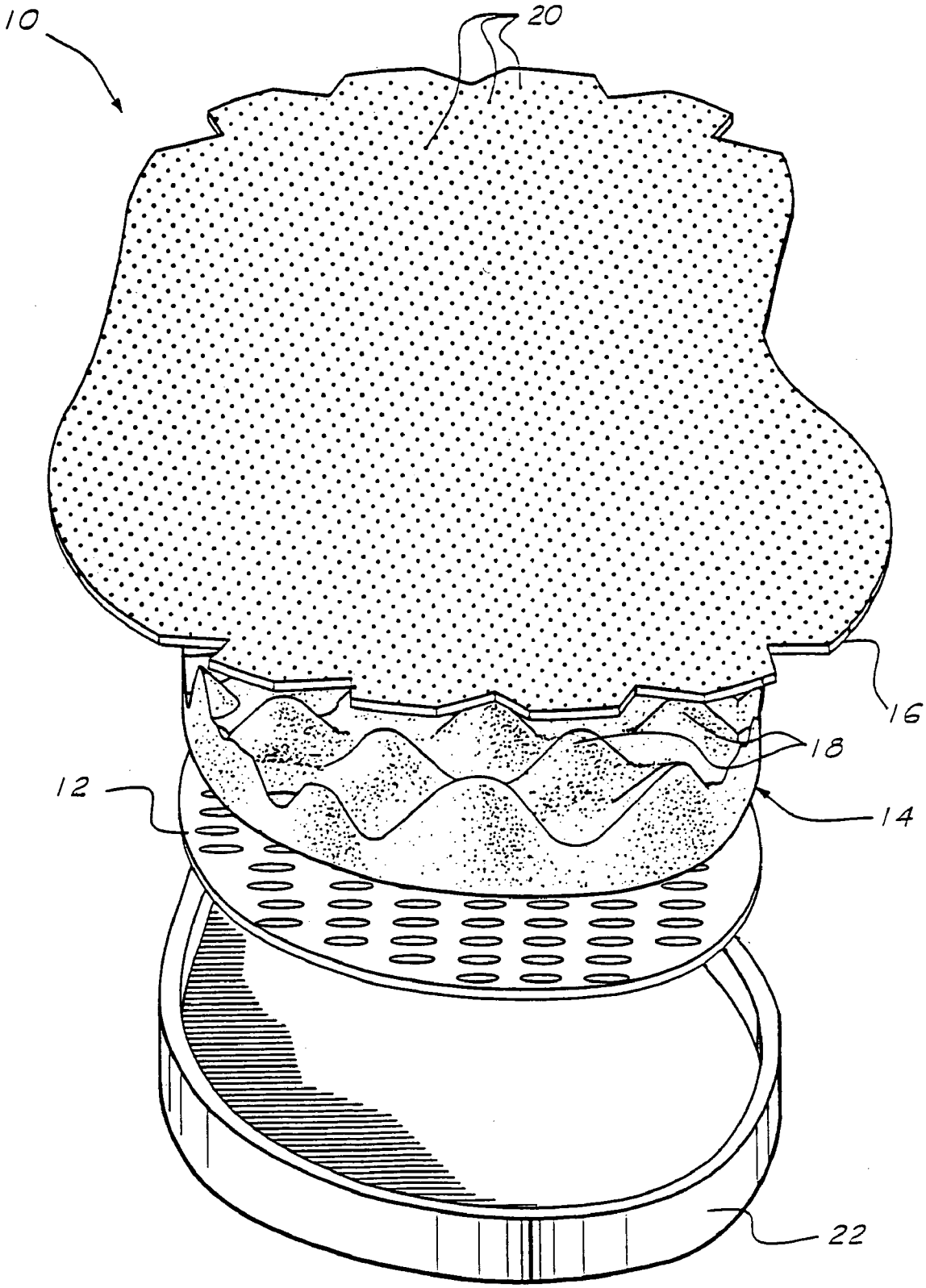
FIG. 2 is an exploded front view of the insole construction and outsole shown in FIG. 1.

Referring to FIGS. 1 and 2, the insole construction 10 of the present invention generally comprises a base member 12, an intermediate member 14 and a cover member 16. The base member 12 preferably is of generally flat construction and is formed of a suitable flexible material, such as plastic, leather, fiberboard or the like. Also, the base member 12 may be provided with a plurality of perforations 13 to enhance the flexibility thereof.

The intermediate member 14 preferably is formed of a foam such as polyurethane foam having a density rating so as to be relatively soft in the nature of the foam used for mattresses, upholstered furniture or the like. As shown in FIGS. 1–4, the intermediate member 14 comprises a plurality of raised portions or cushioning elements 18 of generally curved shape on the upper surface thereof. Preferably, the intermediate member is approximately 6 millimeters in thickness and the raised cushioning elements 18 are approximately 6 millimeters in height above the upper surface of the intermediate member. Also, the raised cushioning elements 18 are substantially uniformly spaced on the intermediate member 14 at a distance of approximately 10–30 millimeters from each other.

The cover member 16 may be formed of any suitable flexible material such as leather and may be of any suitable construction. Preferably, the cover member 16 is provided with a plurality of perforations 20 therethrough for the purpose of enhancing the breathability thereof.

Figure 3:
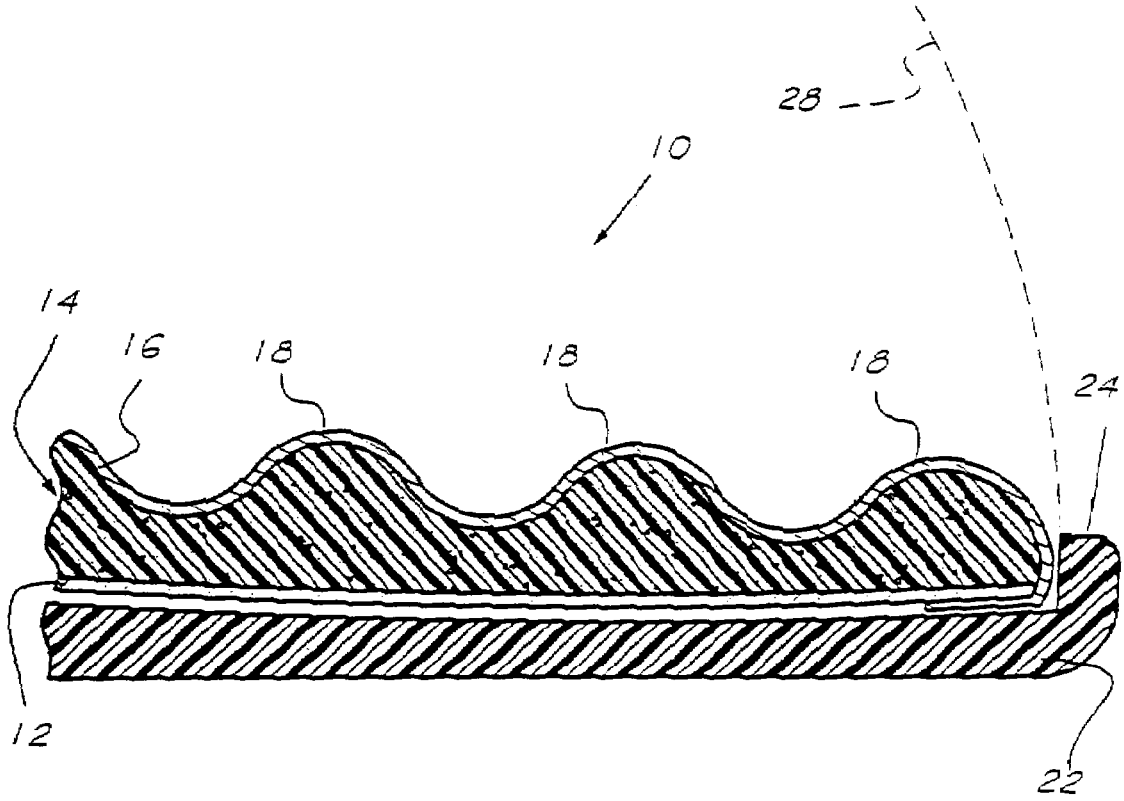
FIG. 3 is a sectional view of the insole construction showing its components in assembled relation.
Figure 4:
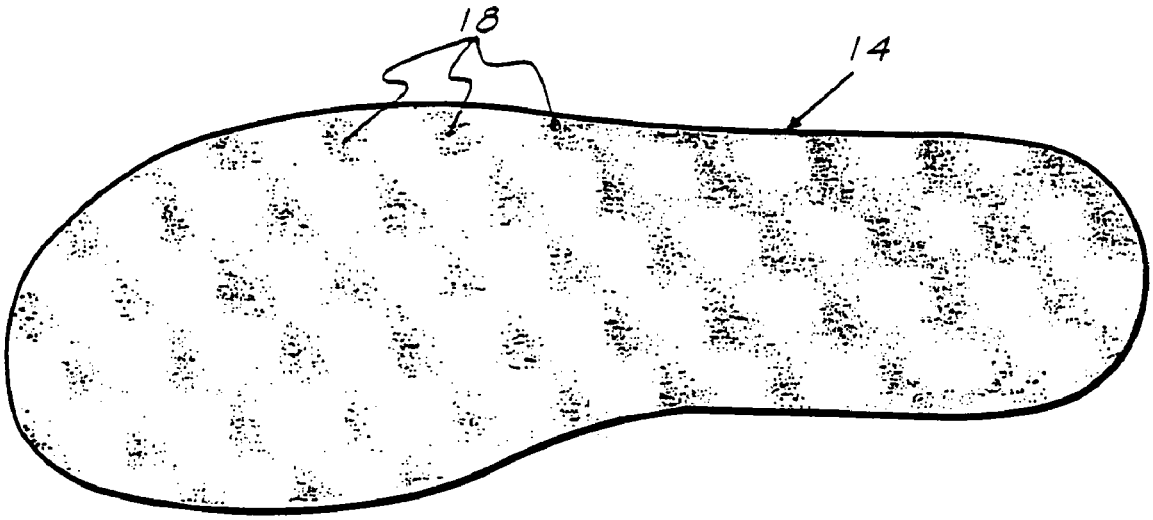
FIG. 4 is a plan view of the top of the intermediate member of the insole construction.

As shown in FIG. 3, in assembled form, the cover member 16 surrounds and encloses the intermediate member 14 and extends beneath and is secured to the lower surface of the base member 12 in any suitable manner, such as by suitable adhesive.

As shown in FIGS. 1–3, the insole construction 10 may be mounted on and secured to an outsole 22 of any suitable shape and construction. The outsole 22 may be provided with an upstanding rim 24 for enclosing the insole construction 10, and also with a plurality of perforations 26 for weight reduction. The outsole may be formed of any suitable material, such as polyurethane, or the like.

Any suitable type of upper 28 (shown in broken lines in FIG. 3) may be utilized in footwear constructed in accordance with the present invention. Although the present invention is particularly effective in sandal-type footwear, it may be used in other types of footwear wherein the upper encloses all or a portion of the foot of the wearer.

The insole construction 10 of the present invention, primarily because of the unique construction of the intermediate member 14, provides enhanced anatomical support, stability and comfort for the foot of the wearer. Because of the relatively soft foam and the size and spacing of the raised cushioning elements 18, the insole construction 10 is self-adjusting to the foot of the wearer such that there is enhanced support for the foot and it is prevented from slipping forwardly, rearwardly or sideways on the insole construction. Accordingly, the insole construction 10 of the present invention provides new and improved comfort, support and stability for the foot of the wearer.

Figure 5:
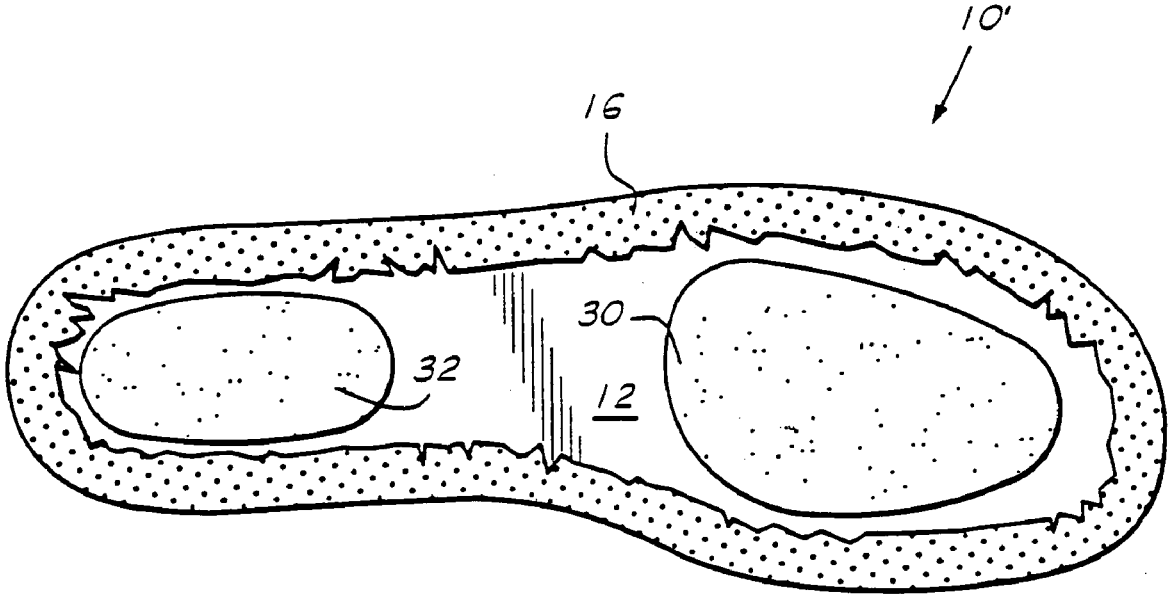
FIG. 5 is a plan view of the bottom of a modified embodiment of the insole construction.

FIG. 5 illustrates a modified embodiment of the insole construction 10 wherein the base member 12 comprises soft, compressible inserts 30 and 32 of any suitable material or construction in the front and rear portions thereof, respectively, to provide additional cushioning in those areas for the foot of the wearer.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims.

What is claimed is:

1. An insole construction for footwear comprising a base member;

an intermediate member formed of a foam and having an upper surface and a plurality of raised cushioning elements on said upper surface thereof; and a flexible cover member surrounding said intermediate member to conform substantially to the shape of said upper surface and the plurality of raised cushioning elements thereof, said cover member extending beneath said base member;

said raised cushioning elements having a height of approximately 6 millimeters above the upper surface of said intermediate member and being spaced on said upper surface at a spacing of approximately 10–30 millimeters.

2. The insole of claim 1, wherein said base member is substantially flat and flexible.

3. The insole construction of claim 2, wherein said base member is provided with a plurality of perforations to increase the flexibility thereof.

4. The insole construction of claim 1 wherein said foam is polyurethane foam.

5. The insole construction of claim 1, wherein said intermediate member has a thickness of approximately 6 millimeters.

6. The insole construction of claim 1, wherein said cover member is perforated.

7. An insole construction for footwear comprising:

a relatively flat, flexible base member;

an intermediate member formed of a foam, and having an upper surface and a plurality of raised cushioning elements spaced on said upper surface thereof, said raised cushioning elements having a height of approximately 6 millimeters above the upper surface of said intermediate member; and a flexible cover member surrounding said intermediate member to conform substantially to the shape of said upper surface and the plurality of raised cushioning elements thereof; said cover member extending beneath said base member.

8. The insole construction of claim 7, wherein said raised cushioning elements are generally curved in shape and are spaced at approximately 10–30 millimeters from each other.

9. The insole construction of claim 8, wherein said flexible cover member is perforated and is secured to said base member.

10. The insole construction of claim 9, wherein said base member is perforated.

11. The insole construction of claim 7, wherein said base member comprises soft, compressible inserts in the front and rear portions thereof to provide additional cushioning for the foot of the wearer.

12. An article of footwear, comprising:

an outsole; and an insole construction mounted on said outsole and comprising a base member, an intermediate member, and a cover member;

said intermediate member being formed of a foam and having an upper surface and a plurality of raised cushioning elements on said upper surface thereof; and said cover member being flexible and surrounding said intermediate member to conform substantially to the shape of said upper surface and the plurality of raised cushioning elements thereof, said cover member extending beneath said base member;

said raised cushioning elements having a height of approximately 6 millimeters above the upper surface of said intermediate member and being spaced on said upper surface at a spacing of approximately 10–30 millimeters.

13. The footwear article of claim 12, wherein said intermediate member is approximately 6 millimeters in thickness.

14. The footwear article of claim 12, wherein an upper is secured to said outsole.

15. The footwear article of claim 12, wherein said outsole has perforations in the upper surface thereof.

16. The footwear article of claim 12, wherein said outsole has an upstanding rim surrounding said insole construction.

17. An article of footwear, comprising:

an outsole; and an insole construction mounted on said outsole and comprising a base member, an intermediate member, and a cover member;

said intermediate member being formed of foam and having an upper surface and a plurality of raised cushioning elements on said upper surface thereof; and said cover member being flexible and surrounding said intermediate member to conform substantially to the shape of said upper surface and the plurality of raised cushioning elements thereof, said cover member extending beneath said base member;

said raised cushioning elements having a height of approximately 6 millimeters above the upper surface of said intermediate member.

* * * * *